US005215441A

United States Patent [19]

Evans et al.

[11] Patent Number: 5,215,441

[45] Date of Patent: Jun. 1, 1993

[54] AIR CONDITIONER WITH CONDENSATE SLINGING FAN

[75] Inventors: Arthur Evans, Sherburne; Rudy Chou, Liverpool, both of N.Y.

[73] Assignee: Carrier Corporation, Syracuse, N.Y.

[21] Appl. No.: 951,251

[22] Filed: Sep. 25, 1992

Related U.S. Application Data

[63] Continuation-in-part of Ser. No. 788,954, Nov. 7, 1991, abandoned.

[51] Int. Cl.[5] ..... F01D 5/16

[52] U.S. Cl. ..... 416/223 R; 416/228; 62/280

[58] Field of Search ..... 416/223 R, 228; 62/280

[56] References Cited

U.S. PATENT DOCUMENTS

| | | | |
|---|---|---|---|
| 33,077 | 8/1861 | Elliott | 416/228 |
| 368,416 | 8/1887 | Mosher | 416/223 R |
| 921,744 | 5/1909 | Scott | 416/223 R |
| 1,051,852 | 1/1913 | Treat | 416/223 R |
| 2,219,826 | 10/1940 | Swinburne et al. | 62/280 |
| 2,617,637 | 11/1952 | Moore | 261/15 |
| 2,869,334 | 1/1959 | Atchison | 62/280 |
| 2,883,837 | 4/1959 | Rose | 62/280 |
| 2,887,854 | 5/1959 | Soder | 62/280 |
| 2,896,424 | 7/1959 | Rose | 62/280 |
| 2,927,442 | 3/1960 | Kooiker | 62/280 |
| 2,934,914 | 5/1960 | Bohman et al. | 62/280 |
| 2,959,030 | 11/1960 | Mehalik | 62/280 |
| 2,978,040 | 4/1961 | Wirkkala | 416/228 |
| 2,979,918 | 4/1961 | Atchison | 62/280 |
| 3,119,242 | 1/1964 | Kramer | 62/280 |
| 3,766,751 | 10/1973 | Ball | 62/280 |
| 3,789,269 | 3/1974 | De Jarlais | 62/280 |
| 3,872,684 | 3/1975 | Scott | 62/280 |
| 4,067,206 | 1/1978 | Smith | 62/280 |
| 4,107,939 | 8/1978 | Bolton et al. | 62/280 |
| 4,120,170 | 10/1978 | Whitwell et al. | 62/91 |
| 4,128,363 | 12/1978 | Fujikake et al. | 416/236 A |
| 4,189,281 | 2/1980 | Katagiri et al. | 415/213 C |
| 4,222,710 | 8/1980 | Katagiri et al. | 416/236 A |
| 4,248,057 | 2/1981 | Yaguchi | 62/280 |
| 4,265,596 | 5/1981 | Katagiri et al. | 416/236 A |
| 4,505,129 | 3/1985 | Yamane et al. | 62/280 |
| 4,664,593 | 5/1987 | Hayashi et al. | 415/119 |
| 4,712,980 | 12/1987 | Gely et al. | 416/228 |
| 4,893,990 | 1/1990 | Tomohiro et al. | 416/228 |
| 4,930,990 | 6/1990 | Brackett | 416/223 R |

FOREIGN PATENT DOCUMENTS

| | | | |
|---|---|---|---|
| 335694 | 3/1959 | Switzerland | 416/223 |

*Primary Examiner*—John T. Kwon

[57] ABSTRACT

An air conditioning system having a fan that moves air over the outside heat exchanger of the system. The fan is of the bladed axial flow type. A winglet projects curvilinearly both radially outward from the trailing end of the tip of each blade of the fan and perpendicularly upward from the blade pressure surface. A conduit directs condensate formed on and dripping from the system inside heat exchanger to a collector located under the fan. The blade winglets scoop condensate from the collector and draw the water inward toward the center of rotation of the fan, where air moving through the fan slings the water on to the outside heat exchanger.

2 Claims, 2 Drawing Sheets

AIR CONDITIONER WITH CONDENSATE SLINGING FAN

This is a continuation-in-part of application Ser. No. 07/788,954, filed 7 November 1991, now abandoned.

BACKGROUND OF THE INVENTION

This invention relates generally to air conditioning systems. More particularly the invention relates to an air conditioning system having an axial flow fan for moving air through a refrigerant condenser.

Warm air is frequently also humid, i.e. it contains entrained water vapor. During operation of an air conditioning system in the cooling mode, the system refrigerant evaporator reduces the temperature of the air passing through it to below the dewpoint. In that condition, water vapor condenses on the evaporator. Some means must be provided to dispose of this condensate. In small unitary air conditioners, such as window or though-the-wall mounted room air conditioners, a common means to accomplish condensate disposal is by providing a condensate collection and drain path that communicates between the inside section and the outside section of the air conditioner. Condensate formed on the system evaporator drains into a collector in the inside section and then flows to a collector located under the condenser fan in the outside section. The outside section condensate collector and the condenser fan are arranged so that the fan will contact the condensate in the collector and sling it on to the hot surfaces of the system condenser where the condensate water evaporates. The arrangement is such that the fan will sling the condensate before the water in the collector rises to a level where it can overflow. A slinger arrangement eliminates the need for an inconvenient, unsightly and costly condensate drain from the air conditioner. There is another benefit from such an arrangement, in that the heat necessary to evaporate the water is taken from and thus assists in cooling the warm refrigerant in the condenser, resulting in an improvement in system efficiency.

Some prior art designs provide condensate slinging capability in a fan by incorporating a shroud or ring as part of the fan. The shroud encircles the fan blades and attaches to each blade at its tip. The shroud contacts the water when the condensate reaches the design level, lifting the water into the moving air stream produced by the fan and causing the water to pass into the condenser.

Condensate disposal arrangements using fans with slinger rings have certain design and performance shortcomings. Not all the water lifted from the condensate collector by the slinger ring is carried into the fan discharge. Some, in the form of droplets, is thrown radially outward until it impacts the system enclosure or other structural components. The impact of the droplets can cause annoying noise. Further, the condensate that does not spray upon the exterior of the condenser tubes is not available to increase the thermal efficiency of the system. Several prior art inventions have dealt with these problems by fitting stationary shrouds around the ringed fan. These stationary shrouds were configured to prevent the impingement of condensate droplets on other system structures and direct the droplets on to the condenser. Hence the configuration of the stationary shrouds were not able to be optimized for other considerations such as fan air flow efficiency and noise reduction.

Encircling a fan with a rotating shroud or ring affixed to it also creates design and manufacturing difficulties, particularly when the fan is made of plastic in one piece. Since the shroud is at the region of maximum rotational velocity, the centrifugal force resulting from its weight is at a maximum for a given fan geometry, requiring that other portions of the fan be made to have the strength necessary to withstand the force generated by the shroud. This requirement may mean that the fan construction must be more robust than would otherwise be required. The junctions where the shroud meets and joins to the tips of the blades can be areas of weakness just where maximum strength is required. Plastic one piece fans are commonly manufactured using an injection molding process, with the point of plastic material injection into the fan mold being in the central or hub area. Achieving a good mold fill on a shrouded fan design can be difficult. In a molded plastic shrouded fan, a zone of reduced strength can be present in the shroud ring at a location equidistant or nearly so from adjacent fan blades because at that location, flows of plastic from opposite directions meet during the molding process but fail to meld and knit properly and completely.

SUMMARY OF THE INVENTION

The present invention is an air conditioning system having an axial flow condenser fan. The fan has a plurality of blades. Each blade has a slinger winglet protruding from the blade outer edge. The winglet extends out from a portion of the blade outer edge that is adjacent the blade trailing edge radially from the center of rotation of the fan. The winglet also extends outward from the pressure surface of the blade. The configuration of the winglet is such that when the tip of the blade enters the surface of water, the winglet scoops up water droplets and directs them radially inward toward the center of rotation of the fan and thus into the discharge air stream leaving the fan.

The placement of a winglet on each blade of the fan is an improvement over a slinger ring or shroud encircling and affixed to the fan blades because it avoids the drawbacks associated with a shrouded configuration as discussed above and allows for a strong but lightweight fan even when fabricated from plastic.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
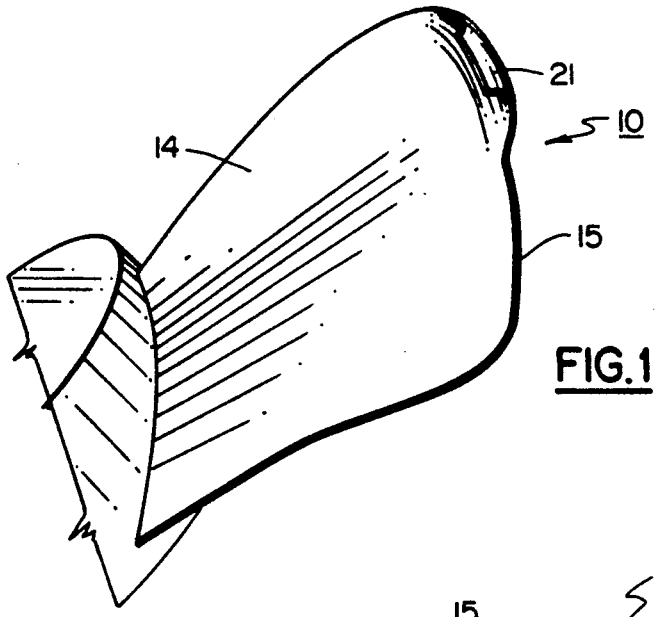
FIG. 1 is a perspective view of a fan blade embodying the present invention.
Figure 4:
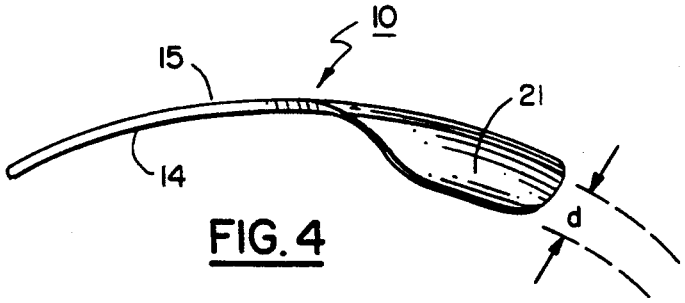
FIGS. 2, 3 and 4 are, respectively, front and side elevation views and a top plan view of a fan blade embodying the present invention.
Figure 2:
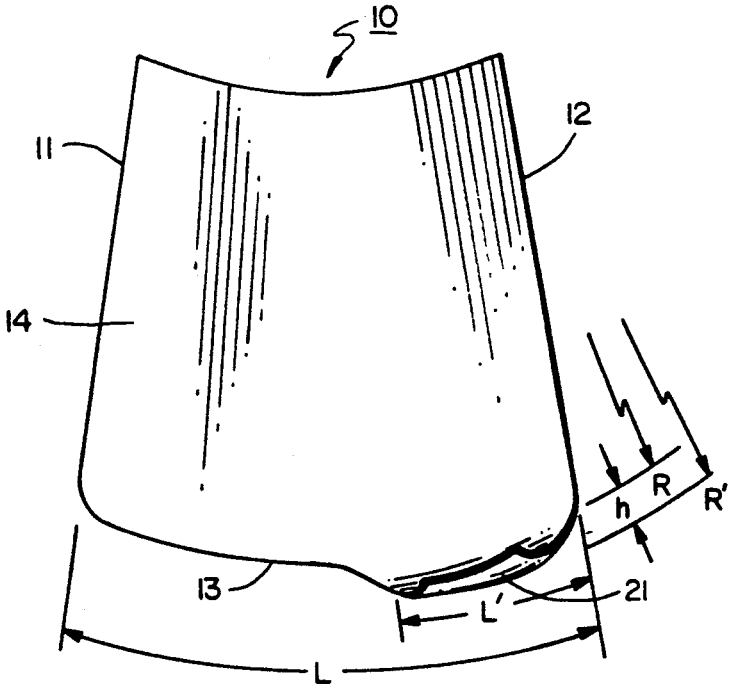
Figure 3:
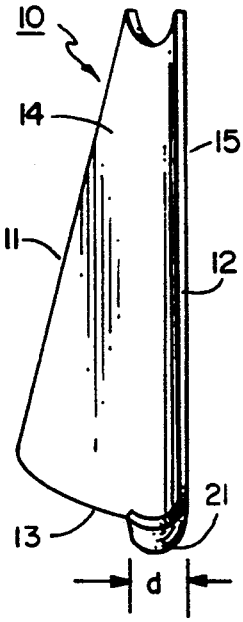

FIGS. 1 through 4 depict in detail one feature of the present invention, a blade of the condenser axial flow fan. Fan blade 10 is visible in all of the figures, while in one or more of the various views contained in the figures can be seen its leading edge 11, trailing edge 12, outer edge 13, pressure surface 14 and suction surface 15. A fan having fan blades 10 rotates in direction D.

Extending from the portion of outer edge 13 that is adjacent to trailing edge 12 is slinger winglet 21. Winglet 21 extends radially and curvilinearly to a maximum distance h from the main portion of outer edge 13. Distance h is the difference between the maximum radius R swept by any point on leading edge 13 and the maximum radius R, swept by any point on winglet 21. Winglet 21 extends curvilinearly to a maximum distance d perpendicularly from pressure surface 14. In a plane perpendicular to pressure surface 14, winglet 21 has a generally "j" shaped cross section.

In an optimum configuration for the winglet, both distance h and distance d should be about ten percent of radius R. The winglet should extend along approximately ten to 30 percent of the blade outer edge chord length, or, referring to FIG. 2, distance L' should be approximately ten to 30 percent of distance L.

With fan blade 10 incorporated into an axial flow fan, the fan installed in the outside section of an air conditioning system as the condenser fan and with a condensate collector under the fan, as the system operates in a humid inside environment, condensate will collect under the evaporator in the inside section of the system and drain to the outside section condensate collector. As the water level in the condensate collector rises, the level will eventually reach a point where the rotating blades of the fan contact the condensate. Because it extends to a greater radius than the main body of the blade, the first part of blade 10 to come in contact with the water will be winglet 21. Winglet 21 scoops the water from the collector and draws it in toward the axis of rotation of the fan. As the water flows on to pressure surface 14, the air flow generated by the fan sweeps the water off fan blade 10 and carries it into the system condenser, where it is deposited on the heat transfer surfaces of the condenser, there to be evaporated and pass into the outside air flowing over the condenser.

Figure 5:
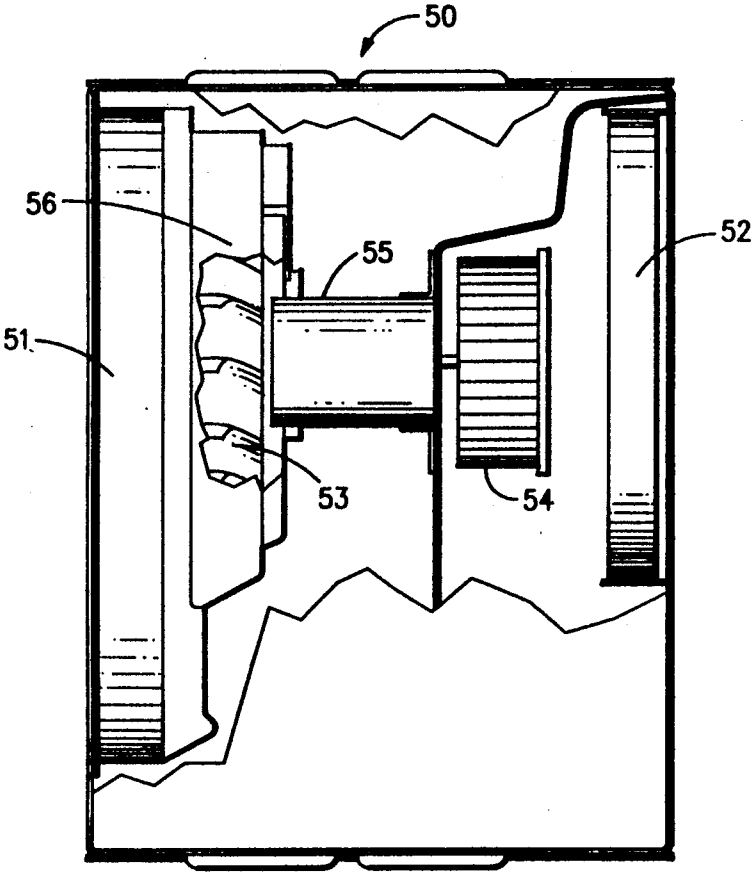
FIG. 5 is a top plan view, partly broken away, of a room air conditioner embodying the present invention.

FIG. 5, in a partly broken away top plan view, depicts the major components of an air conditioning system embodying the present invention. Air conditioning system 50 has outside section refrigerant-to-air heat exchanger 51 and inside section refrigerant-to-air heat exchanger 52. When the system is operating in the cooling mode, heat exchanger 51 functions as a condenser and heat exchanger 52 functions as an evaporator. If the system is reversible, i.e. can operate as what is known in the industry as a heat pump, the functions of the two heat exchangers are reversed. Motor 55 drives both inside fan 54 and outside fan 53. In the system illustrated, fan 54 is of the centrifugal or "squirrel cage" type and fan 53 is of the axial flow type. An orificed stationary shroud 56 surrounds fan 53. Since slinger winglets 21 do not throw water droplets radially, shroud 56 may be configured for optimum air flow and reduction of noise rather than to control the flow of condensate water.

Figure 6:
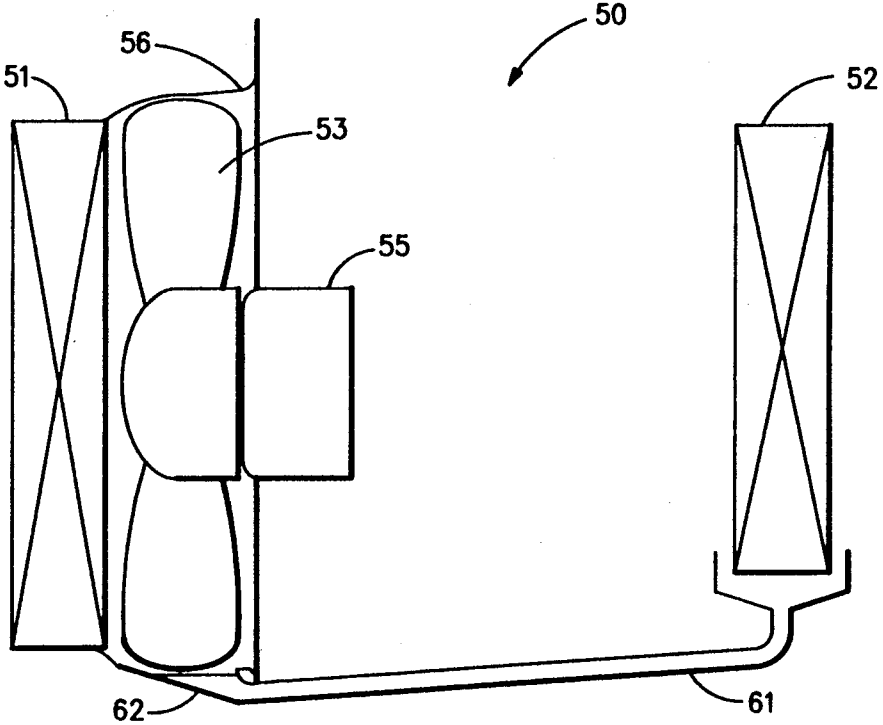
FIG. 6 is a partial schematic depiction of an air conditioning system embodying the present invention.

FIG. 6 shows schematically the arrangement that directs the flow of condensate from heat exchanger 52 to a position where it can be picked up and directed on to the surface of heat exchanger 51 by fan 53. When condensate forms on heat ex=changer 52, it runs off that heat exchanger into inside collector and conduit 61. Conduit 61 directs the condensate to outside collector, that directs the flow of condensate into outside collector 62. Collector 62 is located beneath fan 53 in a position so that winglet 21 on a given blade 10 will extend into collector 62 when that blade is at its lowermost position during rotation. If the condensate level in collector 62 rises above a predetermined level, winglet 21 will contact the condensate water and sling it on to the surface of heat exchanger 51. Depending on the configuration and arrangement of system 50, inside collector and conduit 61 and outside collector 62 may need be no more than depressions stamped or molded in to the bottom of the enclosure for the system.

The above discussion and description of the invention has focussed on its application to use in a unitary or window mounted room air conditioner. The invention may find its greatest utility in that application, but it may be used in many other applications where an axial flow fan is used to cause air movement through an air conditioning condenser as well.

We claim:

1. An improved air conditioning system (50) of the type having a first heat exchanger (52) in a first portion of said system, a second heat exchanger (51) in a second portion of said system, a bladed axial flow fan (53) positioned so as to discharge a stream of air through said second heat exchanger, each of the blades (10) of said fan having a trailing edge (12), an outer edge (13) and a pressure surface (14), a condensate collector (62) located below said fan and means (61) for transferring condensate formed by said first heat exchanger from said first portion to said collector in which the improvement comprises:

a slinger winglet (21) on each of said blades that extends from each of said blades generally along said outer edge from said trailing edge for ten to 30 percent (10 to 30%) of the chord length of said outer edge, said winglet extending curvilinearly both radially outward from said outer edge to a maximum distance equal to eight of 12 percent (8 to 12%) of the radius swept by said outer edge and perpendicularly outward from said pressure surface to a maximum distance equal to eight to 12 percent (8–12%) of the radius swept by said outer edge.

2. The air conditioning system of claim 1 in which said winglet has a generally "J" shaped cross section.

* * * * *